US009741176B2

(12) United States Patent
Chen et al.

(10) Patent No.: US 9,741,176 B2
(45) Date of Patent: Aug. 22, 2017

(54) LOTTERY TICKET DISPENSING DEVICE

(71) Applicant: BEIJING FULEI INDUSTRIAL & COMMERCIAL CO., LTD., Beijing (CN)

(72) Inventors: Bo Chen, Beijing (CN); Zhanfu Chang, Beijing (CN)

(73) Assignee: BEIJING FULEI INDUSTRIAL & COMMERCIAL CO., LTD., Beijing (CN)

( * ) Notice: Subject to any disclaimer, the term of this patent is extended or adjusted under 35 U.S.C. 154(b) by 37 days.

(21) Appl. No.: 14/908,760

(22) PCT Filed: Aug. 12, 2013

(86) PCT No.: PCT/CN2013/081262
§ 371 (c)(1),
(2) Date: Jan. 29, 2016

(87) PCT Pub. No.: WO2015/018097
PCT Pub. Date: Feb. 12, 2015

(65) Prior Publication Data

US 2016/0171784 A1 Jun. 16, 2016

(30) Foreign Application Priority Data

Aug. 5, 2013 (CN) ..... 2013 1 0336673

(51) Int. Cl.
*B65H 35/10* (2006.01)
*G07B 5/02* (2006.01)
*G07B 3/02* (2006.01)

(52) U.S. Cl.
CPC ..... *G07B 5/02* (2013.01); *G07B 3/02* (2013.01); *B65H 35/10* (2013.01); *Y10T 225/35* (2015.04)

(58) Field of Classification Search
CPC ..... B65H 35/10
(Continued)

(56) References Cited

U.S. PATENT DOCUMENTS 4,697,726 A * 10/1987 Gaucher ..... B41L 1/12 225/100
5,836,498 A * 11/1998 Turek ..... B26F 3/002 225/1

(Continued)

FOREIGN PATENT DOCUMENTS

CN 201903911 U 7/2011
CN 102142164 A 8/2011

(Continued)

OTHER PUBLICATIONS

Chinese Office Action and Search Report Dated Mar. 2, 2016 concerning corresponding Chinese Patent Application No. CN 201310336673.X.

(Continued)

*Primary Examiner* — Kenneth E. Peterson
*Assistant Examiner* — John E Grosselin, III
(74) *Attorney, Agent, or Firm* — Typha IP LLC

(57) ABSTRACT

A lottery ticket distribution device (10) for dispensing scratch-off lottery tickets, which includes; a housing, a lottery ticket feeding device, a cutter (36), a guiding press plate (38), and a guiding press plate drive device and a control device (23). The guiding press plate drive device includes a linear electromagnet (50), a lever (51), a pulling plate (52) and a spring (53). The linear motion of the linear electromagnet (50) pushes the lever (51) to rotate, and the rotation of the lever (51) drives the pulling plate (52) and the guiding press plate (38) connected to the pulling plate (52) to rotate, so that a lottery ticket tape (16) is bent toward the cutter (36). The lottery tickets feeding device makes the (Continued)

lottery tickets to roll back, thereby a lottery ticket is separated.

5 Claims, 4 Drawing Sheets

(58) Field of Classification Search
USPC ..... 225/100; 83/648–649
See application file for complete search history.

(56) References Cited

U.S. PATENT DOCUMENTS

| | | | | |
|---|---|---|---|---|
| 5,950,898 | A * | 9/1999 | Menna | G07B 3/00 225/10 |
| 6,609,644 | B1 * | 8/2003 | Menna | G07B 3/00 225/104 |
| 6,669,071 | B1 | 12/2003 | Menna | |
| 7,364,058 | B2 * | 4/2008 | Bartolone | G07B 3/00 225/106 |
| 7,562,798 | B2 | 7/2009 | Bartolone et al. | |
| 2004/0200874 | A1 * | 10/2004 | Menna | G07B 3/00 225/106 |

FOREIGN PATENT DOCUMENTS

| | | | |
|---|---|---|---|
| CN | 102637305 | A | 8/2012 |
| CN | 102142164 | B | 6/2013 |
| CN | 203480532 | U | 3/2014 |
| JP | H0822553A | A | 1/1996 |
| JP | 2007-018396 | A | 1/2007 |

OTHER PUBLICATIONS

International search report of PCT/CN2013/081262 dated on May 21, 2014.

* cited by examiner

LOTTERY TICKET DISPENSING DEVICE

CROSS-REFERENCE TO RELATED APPLICATION

This application is entering into the national phase of PCT application No. PCT/CN2013/081262, filed on Aug. 12, 2013, which claims the priority from Chinese Patent Application No. 201310336673.X, filed on Aug. 5, 2013, the entire contents of which are incorporated herein by reference.

FIELD OF THE INVENTION

The present invention relates to a lottery ticket dispensing device for dispensing scratch-off lottery tickets, which is mounted on an automatic lottery ticket-vending machine, for automatically dispensing scratch-off lottery tickets that are separated from a continuous lottery ticket tape provided with penetrative parting lines.

BACKGROUND OF THE INVENTION

At present, scratch-off lottery ticket games are still very popular. Traditionally, the scratch-off lottery tickets are distributed by sales clerks, who manually tear off a required number of lottery tickets from a lottery ticket tape and sell the lottery tickets to a lottery ticket buyer. However, manual vending requires a professional watcher, and vending errors may occur when the sales clerk is engaged in other tasks, or loss of lottery tickets may even occur. In addition, lottery ticket vending is a public welfare undertaking, and the gross profit rate of the vendor is fixed, lower than other consumer products. With the increase of labor cost and property cost, the traditional manual vending mode is facing a challenge.

In order to more simply and effectively distribute scratch-off lottery tickets, some automatic lottery ticket dispensing devices have been developed, for example, the lottery ticket dispensing devices in U.S. Pat. Nos. 6,669,071B1 and 7,562,798B2. Although great progress has been made by these lottery ticket dispensing devices in automatic dispensing of lottery tickets, there still exist certain problems and defects technically.

In the lottery ticket dispensing device disclosed in U.S. Pat. No. 6,669,071B1, a guiding press plate is driven to rotate by a solenoid, and the guiding press plate presses a lottery ticket tape with penetrative parting lines to an assigned position and in contact with a cutter, then an electrical motor rotates reversely and drives the lottery ticket tape to roll back, thereby the cutter cuts off a penetrative parting line on the lottery ticket tape, and a lottery ticket is separated. In such a lottery ticket dispensing device, the rotary motion of a solenoid is employed to drive the guiding press plate; however, the cost of such a solenoid itself is very high, and moreover, the structure of the solenoid is complex, failures and problems tend to occur, and the lifetime is short. When a solenoid is employed to drive the guiding press plate, the pause time of the guiding press plate will be short, which is unfavorable for separating a lottery ticket from the lottery ticket tape. Moreover, when a solenoid is employed to drive the guiding press plate, it needs to add an additional shaft for driving the guiding press plate, which will increase the cost. Additionally, in U.S. Pat. No. 6,669,071B1, a structure with two press roller is employed to drive the lottery ticket tape, and problems may occur in the ticket dropping process after a ticket is cut off; for example, if there remains a last lottery ticket on the lottery ticket tape, it will be unable to discharge the last lottery ticket. In U.S. Pat. No. 6,669,071B1, a pair of transmitting-receiving sensors are employed, there exist cumulative errors, and erroneous judgment may be caused by pollutants, for example, paper scraps, on the sensor. Additionally, in the lottery ticket dispensing device disclosed in U.S. Pat. No. 6,669,071B1, no ticket guiding device exists between the cutter and the roller, thus failures such as ticket blocking tend to occur.

In the lottery ticket dispensing device disclosed in U.S. Pat. No. 7,562,798B2, a mechanical clutch assembly is employed to replace the solenoid in U.S. Pat. No. 6,669,071B1 for driving the guiding press plate to realize the separation of lottery tickets. However, the mechanical clutch assembly employed in U.S. Pat. No. 7,562,798B2 has a complex structure, and it is inconvenient for mounting. Moreover, the mechanical clutch component has strict requirements on machining accuracy and mounting accuracy; otherwise, a ticket cutting error tends to occur. Similarly, in the lottery ticket dispensing device disclosed in U.S. Pat. No. 7,562,798B2, no ticket guiding device exists between the cutter and the roller, thus failures such as ticket blocking tend to occur.

Therefore, it needs to develop a lottery ticket dispensing device that has higher dispensing efficiency, lower cost, easy operation and high reliability.

SUMMARY OF THE INVENTION

The invention provides a modified lottery ticket dispensing device, thereby solving one or more of the above problems of the prior art.

The lottery ticket dispensing device according to the invention includes: a housing; a lottery ticket feeding device mounted on the housing, which includes: a drive motor, a first drive roller and a driven roller, wherein the drive motor drives the first drive roller to rotate, the driven roller is pressed against the first drive roller, and a lottery ticket tape is allowed to pass between the first drive roller and the driven roller; a cutter, which is fixed on the housing, for separating the lottery ticket tape; a guiding press plate, which can rotate to make a lottery ticket tape bend toward the cutter along a penetrative parting line thereon and make the penetrative parting line contact the cutter; a guiding press plate drive device, which includes a linear electromagnet, a lever, a pulling plate and a spring, wherein the linear electromagnet is fixed on the housing, the lever is rotatably mounted on the housing, the first end of the lever contacts a push rod of the linear electromagnet, and the second end of the lever is rotatably connected with the first end of the pulling plate, the second end of the pulling plate is rotatably connected with the guiding press plate, the first end of the spring is fixed on the housing, and the second end of the spring is connected with the pulling plate; and a control device, which controls the rotation of the drive motor and thus controls the forward and backward movement of the lottery ticket tape, and further controls the driving and releasing of the linear electromagnet.

According to the above lottery ticket dispensing device according to the invention, when a lottery ticket tape is fed to an assigned position as driven by the lottery ticket feeding device, the control device sends a drive signal to the linear electromagnet and drives the linear electromagnet, so that the push rod of the linear electromagnet propels the lever to rotate. The lever drives the pulling plate to rotate, so that the guiding press plate rotatably connected with the pulling plate is made to rotate toward the lottery ticket tape, the lottery ticket tape is pressed to the cutter along a penetrative parting line thereon, and the cutter contacts the penetrative parting line on the lottery ticket tape. At this time, the control device sends a signal to the drive motor and makes the drive motor rotate reversely, the lottery ticket tape is driven to roll back, and the cutter separates the lottery ticket tape along the penetrative parting line, so that a lottery ticket is separated. After the lottery ticket is separated, the linear electromagnet is released, and the push rod recovers its original position. At this time, the pulling plate is pulled by the restoring force of the spring of the guiding press plate drive device, so that the lever recovers its original position, thereby the next lottery ticket separating action may be performed.

According to the above lottery ticket dispensing device, a guiding press plate drive device, which includes a linear electromagnet, a lever, a pulling plate and a spring, is used to replace the solenoid or the mechanical clutch assembly of the prior art. Because the elements such as linear electromagnet, lever, pulling plate and spring, etc., are very cheap, and the requirements on machining and mounting accuracy are not strict, the cost of the lottery ticket dispensing device may be lowered significantly. Additionally, in comparison with the solenoid or the mechanical clutch assembly, the linear electromagnet has higher reliability, the failure rate may be lowered effectively, and the service life of the lottery ticket dispensing device may be increased.

According to a preferred embodiment of the invention, the lottery ticket feeding device may further include: a second drive roller, which is mounted behind the first drive roller along the lottery ticket feeding direction and is set adjacent the cutter. The second drive roller may still be driven by the drive motor. The second drive roller may share one rotation axis with the guiding press plate; however, the second drive roller and the guiding press plate rotate independently. By adding a second drive roller, after the lottery ticket tape leaves the first drive roller and the driven roller, it may still be fed continuously via the rotation of the second drive roller, thus it may be effectively prevented that a failure occurs during lottery ticket dispensing; especially, the last lottery ticket may be discharged successfully.

According to a preferred embodiment of the invention, the above lottery ticket dispensing device may further include: a ticket guiding device, which is mounted behind the first drive roller and the driven roller along the lottery ticket feeding direction and has a guide surface, wherein the ticket guiding device is set in such a way that a lottery ticket will contact the guide surface after the front edge of the lottery ticket leaves the first drive roller and the driven roller, so that the lottery ticket tape is guided to the cutter. By adding a ticket guiding device, it may be prevented that failures such as ticket blocking and the like occur during lottery ticket feeding.

According to a preferred embodiment of the invention, the rotation axis of the lever, the rotation axis of the guiding press plate and the rotation axis of the second drive roller are set coaxially, and the lever, the guiding press plate and the second drive roller rotate independently.

According to a preferred embodiment of the invention, the above lottery ticket dispensing device may further include: a first sensor and a second sensor, wherein the first sensor is set in front of the first drive roller and the driven roller along the lottery ticket tape feeding direction, and the second sensor is set behind the first drive roller and the driven roller along the lottery ticket tape feeding direction. By mounting a first sensor and a second sensor along the lottery ticket tape feeding path, the lottery ticket tape that is fed along the feeding path may be aligned, and possible cumulative error may be eliminated.

REFERENCE NUMBERS

Figure 1:
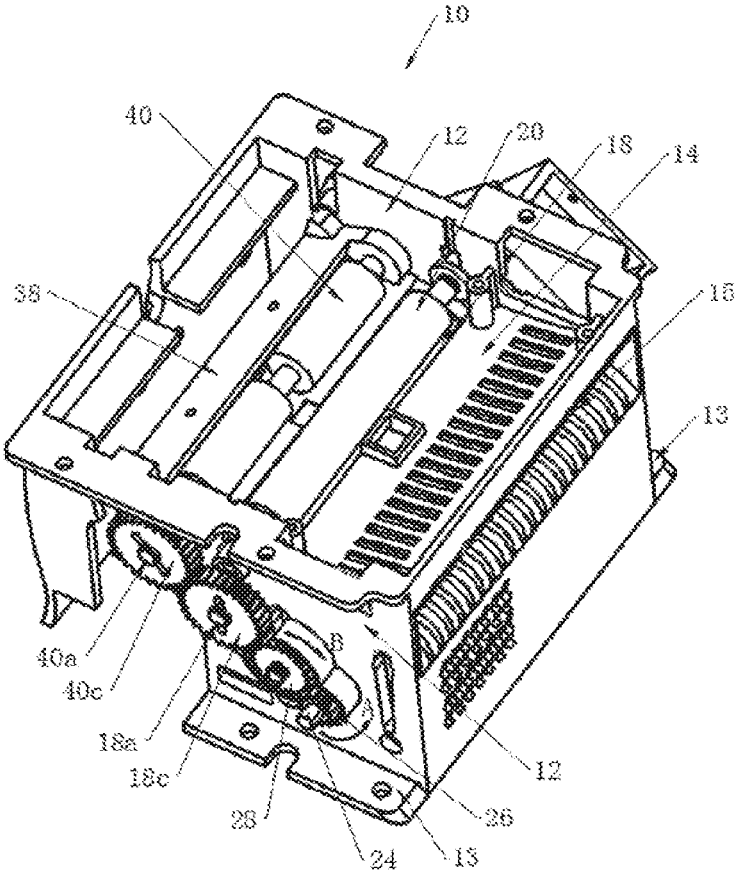
FIG. 1 is a top perspective view of a lottery ticket dispensing device according to the invention.

10 Lottery Ticket Dispensing Device
12 Support Plate
13 Flange
14 Ticket Feed Guide Plate
15 Ticket Feed Bearing Plate
16 Lottery Ticket Tape
18 First Drive Roller
18*a* First Drive Roller Shaft
18*c* First Drive Roller Gear
20 Driven Roller
20*a* Driven Roller Shaft
20*c* Driven Roller Gear
21*a* Spring
21*b* Spring Opening
22 Drive Motor
23 Control Device
24 Electrical Motor Output Shaft
26 Drive Gear
28 Transfer Gear
36 Cutter
37 Cutter Mounting Plate
38 Guiding Press Plate
39 Ticket Guiding Device
39' Guide Surface
40 Second Drive Roller
40*a* Second Drive Roller Shaft
40*c* Second Drive Roller Gear
43 First Sensor
44 Second Sensor
50 Linear Electromagnet
51 Lever
52 Pulling plate
53 Spring

DETAILED DESCRIPTION OF THE EMBODIMENTS

The embodiments of the lottery ticket dispensing device according to the invention will be described in detail below in conjunction with the drawings. Schematic diagrams of the lottery ticket dispensing device according to the invention are shown in the drawings. It should be noted that, the drawings and the embodiments described below are examples only, rather than limiting the invention.

As shown in FIGS. 1-7, the lottery ticket dispensing device according to the invention is generally referred to as 10, and such a lottery ticket dispensing device 10, mounted on an automatic lottery ticket vending machine, may be used for automatically dispensing scratch-off lottery tickets, i.e., a continuous lottery ticket tape 16 set with penetrative parting lines thereon.

As shown in FIG. 1, the lottery ticket dispensing device 10 includes a housing, which is formed of a pair of support plates 12 that are spaced apart oppositely and arranged in parallel. The housing is used to accommodate and support various devices mounted thereon. Each support plate 12 is formed with at least one flange 13 that extends along the lateral part of the support plate, and the flange 13 may be connected to the rack of an automatic lottery ticket vending machine via a bolt or the like, thereby the lottery ticket dispensing device may be mounted to the automatic lottery ticket vending machine. The housing is set with a planar ticket feed guide plate 14, which extends between two support plates 12 and is connected with the two support plates 12. A ticket feed bearing plate 15 is set under the ticket feed guide plate 14, and the ticket feed bearing plate 15 is spaced apart from the ticket feed guide plate 14 and is substantially parallel to the ticket feed guide plate 14, thereby a ticket feeding port for inserting a lottery ticket tape 16 is formed between the ticket feed guide plate 14 and the ticket feed bearing plate 15.

Figure 2:
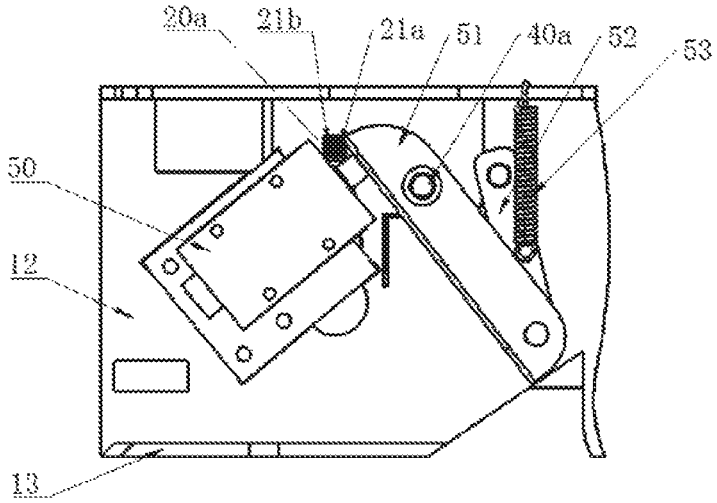
FIG. 2 is a left view of the lottery ticket dispensing device in FIG. 1.

The lottery ticket tape 16 is driven by a lottery ticket feeding device to dispense lottery tickets. The lottery ticket feeding device includes a drive motor 22, a first drive roller 18 and a driven roller 20. The drive motor 22 is mounted on a support plate 12 and has a certain distance from the ticket feed guide plate 14. The drive motor 22 may include a step motor, a servo motor or an electrical motor of other types. The first drive roller 18 and the driven roller 20 are mounted on the support plate 12 via a pair of shaft liners (not shown) and extend between two support plates 12. The first drive roller 18 and the driven roller 20 are mounted in such a way that they are rotatable and are pressed against each other, and the lottery ticket tape 16 is allowed to pass therebetween. Therefore, a spring 21*a* may be set respectively on the two ends of the shaft 20*a* of the driven roller 20 along the radial direction for pressing the driven roller 20 against the first drive roller 18. As shown in FIG. 2, the shaft liner related to the driven roller 20 matches the spring 21*a* that is set in a corresponding opening 21*b* formed on the support plate 12, thereby, the shaft 20*a* of the driven roller 20 may still rotate in the corresponding shaft liner when pressed by the spring 21*a*. The first drive roller 18 may have the similar settings, although it is not shown in the figure.

The operation of the drive motor 22 is controlled by a control device 23. For example, the control device 23 is a printed circuit driven by a computer, or other known types of drives or control circuits connected with appropriate driving input devices. As shown in FIG. 1, if the drive motor 22 operates under the control of the control device 23, an electrical motor output shaft 24 rotates along arrow direction A, then a drive gear 26 mounted on the electrical motor output shaft 24 also rotates along arrow direction A. The drive gear 26 is engaged with a transfer gear 28 and drives the transfer gear 28 to rotate along arrow direction B. The transfer gear 28 is engaged with a first drive roller gear 18*c* that is connected with one end of the first drive roller shaft 18*a*, and it drives the first drive roller gear 18*c* and the first drive roller shaft 18*a* to rotate along arrow direction A, thereby the first drive roller 18 is made to rotate along arrow direction A. Because the driven roller 20 is pressed against the external surface of the first drive roller 18, it rotates along a direction that is opposite to that of the first drive roller 18 as driven by the first drive roller 18.

Figure 5:
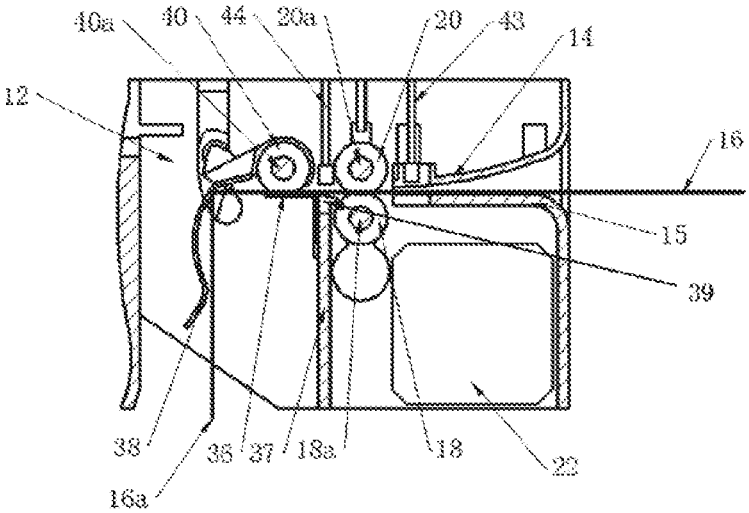
FIG. 5 is a cutaway view of the lottery ticket dispensing device in FIG. 1.
Figure 6:
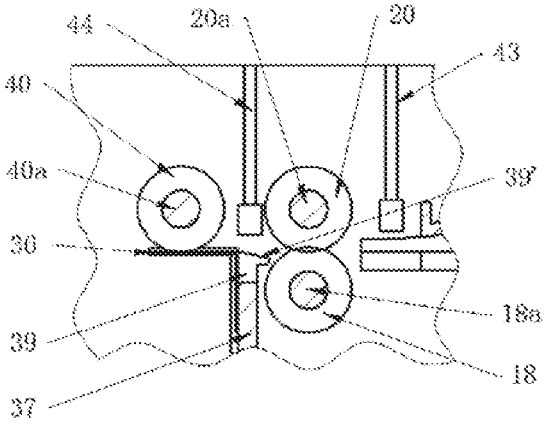
FIG. 6 is a partial view of FIG. 5, wherein the lottery ticket tape is removed for showing the ticket guiding device more clearly.
Figure 7:
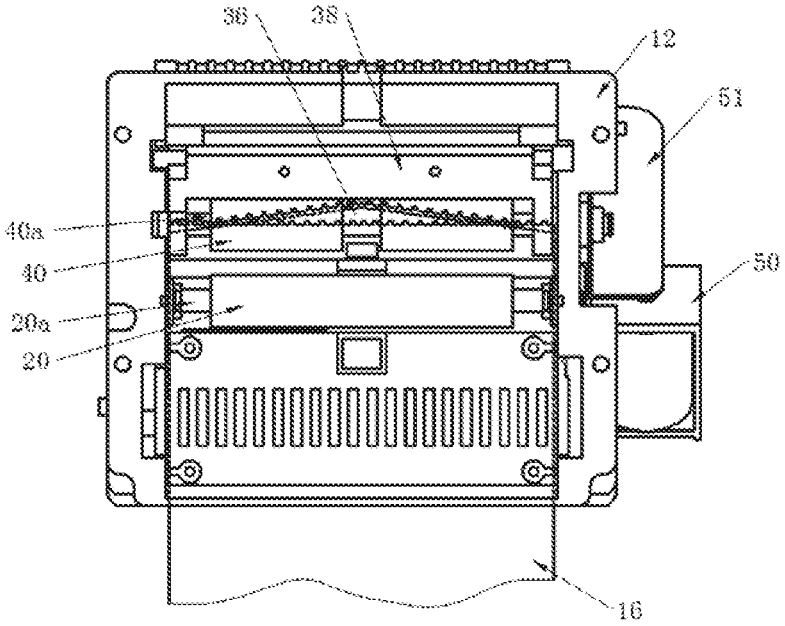
FIG. 7 is a top view of the lottery ticket dispensing mechanism in FIG. 1, which shows that a cutter separates a continuous lottery ticket tape along a penetrative parting line.

As shown in FIG. 5, the lottery ticket dispensing device 10 further includes a cutter 36, which is detachably mounted on a cutter mounting plate 37. The cutter mounting plate 37 is set between two support plates 12 and is perpendicular to the support plate 12, and it is adjacent to the first drive roller 18 and the driven roller 20. A ticket guiding device 39 is set on the cutter mounting plate 37, and the ticket guiding device 39 has a guide surface 39'(see FIG. 6); the guide surface 39' of the ticket guiding device 39 is aligned with the upper surface of the cutter 36, and the guide surface 39' extends toward the first drive roller 18. Thereby, the front edge of the lottery ticket tape 16, which has passed through the first drive roller 18 and the driven roller 20, contacts the guide surface of the ticket guiding device 39 and is guided to the upper surface of the cutter 36, rather than being blocked in the gap between the cutter 36 and the first drive roller 18.

As shown in FIG. 1 and FIG. 5, a second drive roller 40 is set behind the first drive roller 18 and the driven roller 20 along the feeding direction of the lottery ticket tape 16. The second drive roller gear 40*c* and the first drive roller gear 18*c* are mounted on the same side of the same support plate 12, and the first drive roller gear 18*c* is engaged with the second drive roller gear 40*c*. The rotation of the first drive roller gear 18*c* drives the second drive roller gear 40*c* to rotate along direction B (see FIG. 1), thereby the second drive roller 40 rotates in the clockwise direction in FIG. 5 for feeding the lottery ticket tape 16 in the ticket dispensing direction.

As shown in FIG. 5, a guiding press plate 38 for bending the lottery ticket tape 16 is rotatably mounted on the second drive roller shaft 40*a* and extends between the support plates 12. Although the guiding press plate 38 is also mounted on the second drive roller shaft 40*a*, the rotation of the guiding press plate 38 is independent of the second drive roller 40; in other words, the guiding press plate 38 is only supported on the second drive roller shaft 40*a*, but it will not rotate along with the rotation of the second drive roller 40, and the rotation of the guiding press plate 38 is controlled by a guiding press plate drive device that will be described below.

Figure 3:
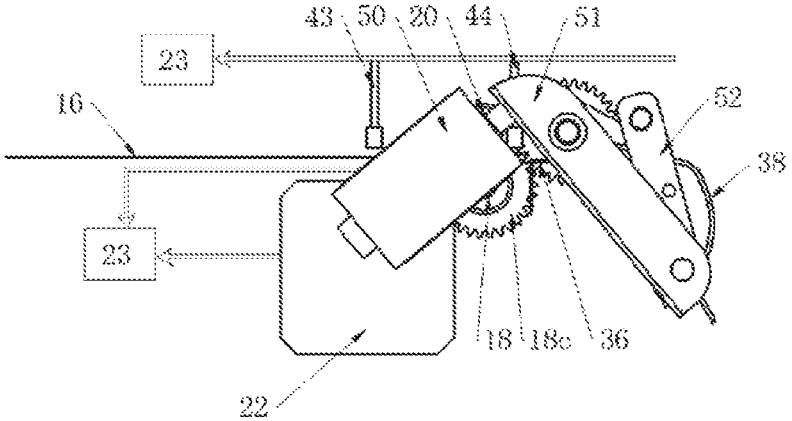
FIG. 3 is a side view of the lottery ticket dispensing device of FIG. 2 after a support plate is removed.

As shown in FIGS. 2, 3, 4, 6, the lottery ticket dispensing device according to the invention includes a guiding press plate drive device, which may be mounted on one side of a support plate 12 and be opposite to the first drive roller gear 18*c* and the second drive roller gear 40*c*. The guiding press plate drive device includes a linear electromagnet 50, a lever 51, a pulling plate 52 and a spring 53. The linear electromagnet 50 is fixed on the outside of the support plate 12 of the housing. The linear electromagnet 50 includes a push rod, which contacts the first end of the lever 51 (the end part of the short arm in FIG. 2). The lever 51 is rotatably mounted on the housing. As shown in FIG. 2, the rotation axis of the lever 51 and the second drive roller shaft 40*a* are coaxial; however, the rotation of the lever 51 is independent of the second drive roller 40. The second end of the lever 51 (the end part of the long arm in FIG. 2) is rotatably connected with the first end of pulling plate 52. As shown in FIG. 3, the second end of the pulling plate 52 is rotatably connected with the guiding press plate 38. The lever 51 includes a supporting point, which is rotatably supported on the support plate 12 of the housing. The first end of the spring 53 is fixed on the support plate of the housing, and the second end of the spring 53 is connected at a position between the first end and the second end of pulling plate 52. Preferably, the spring 53 is a tension spring.

As shown in FIG. 5, the lottery ticket dispensing device according to the invention further includes a first sensor (also called lottery ticket inputting sensor) 43 and a second sensor (also called transmitting and loading sensor) 44, for providing feedback information about the position of the continuous lottery ticket tape 16 to the control device 23. The first sensor 43 is mounted in front of the first drive roller 18 and the driven roller 20 along the lottery ticket feeding path, and the second sensor 44 is mounted behind the first drive roller 18 and the driven roller 20 and in front of the second drive roller 40 along the lottery ticket feeding path. In the embodiment shown in FIG. 5, the second sensor 44 is opposite to the ticket guiding device 39 above the cutter mounting plate 37. The first sensor 43 is used to detect whether the lottery ticket tape 16 is inserted in the ticket feeding port, and once it detects that the lottery ticket tape 16 is inserted, the drive motor 22 starts to drive the first drive roller 18 to rotate for feeding and loading the lottery ticket tape 16 in the ticket dispensing direction. The second sensor 44 is used to detect whether the lottery ticket tape 16 is loaded, that is, to detect whether the front edge of the lottery ticket tape 16 has passed between the first drive roller 18 and the driven roller 20.

As shown in FIG. 3, the lottery ticket dispensing device according to the invention further includes a control device 23. The signal lines of the drive motor 22, the linear electromagnet 50, the first sensor 43 and the second sensor 44 are all connected to the control device 23. The control device 23 controls the rotation direction and rotation time of the drive motor 22, thereby controlling the forward and backward movement of the lottery ticket tape 16 and the feed length of the lottery ticket tape 16. The control device 23 receives a detection signal from the first sensor 43 and the second sensor 44. The control device 23 further controls the driving and releasing of the linear electromagnet 50.

The operation by which the lottery ticket dispensing device 10 dispenses the continuous lottery ticket tape 16 will be described below.

A forward feed distance of the lottery ticket tape 16, i.e., the length of a certain scratch-off lottery ticket sold by the lottery ticket dispensing device 10, is preset, which may be stored in the control device 23 and controlled by the control device 23.

A lottery ticket tape is loaded. Specifically, a continuous lottery ticket tape 16 is output from a storage box (not shown) or other storage device, and it is manually or automatically inserted in a ticket feeding port formed between the ticket feed guide plate 14 and the ticket feed bearing plate 15. Once the first sensor 43 detects that the lottery ticket tape 16 is inserted in the ticket feeding port, it sends a signal to the control device 23. The control device 23 starts to drive the first drive roller 18 to rotate according to the signal received, and at the same time, it drives the second drive roller 40 to rotate together. The rotation of the first drive roller 18 feeds the lottery ticket tape 16 forward and makes it pass between the first drive roller 18 and the driven roller 20, then the lottery ticket tape 16 contacts the guide surface 39' of the ticket guiding device 39, and it is fed forward successfully under the guide of the guide surface 39' until the front edge of the lottery ticket tape 16 reaches the second sensor 44, thus the process of loading a lottery ticket tape is completed.

A lottery ticket is dispensed (vending a lottery ticket). Specifically, after receiving an external drawing instruction, the front edge of the lottery ticket tape 16 advances a predetermined distance (for example, 20-40 mm, and preferably, 28 mm) from the second sensor 44, and this distance equals to the length of the scratch-off lottery ticket that is being vended plus 28 mm, and at this time, the control device 23 sends a signal to the drive motor to stop the driving of the drive motor 22. At the same time, the control device 23 sends a signal to the linear electromagnet 50 to start the action of bending the scratch-off lottery ticket to be distributed along a penetrative parting line of the lottery ticket tape 16.

Figure 4:
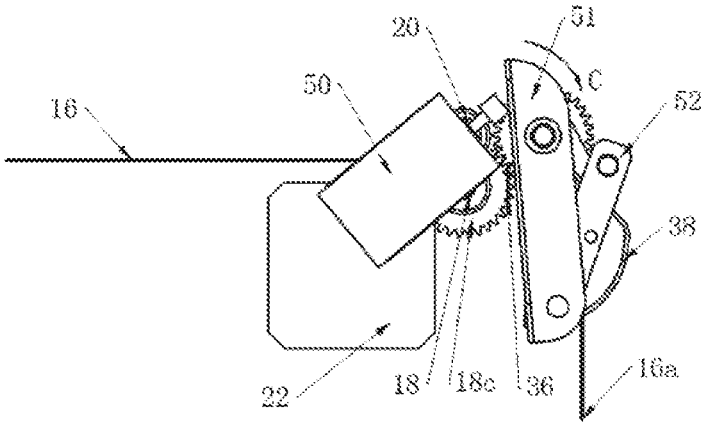
FIG. 4 is a side view of the guiding press plate drive device in FIG. 3.

After the linear electromagnet 50 receives a signal from the control device 23, it propels the push rod to move forward linearly and push the first end of the lever 51, thereby propelling the lever 51 to rotate in the clockwise direction in FIG. 2. The second end of the lever 51 drives the pulling plate 52, which matches the second end of the lever 51, to also rotate in the clockwise direction in FIG. 2, thereby driving the guiding press plate 38, of which one end is rotatably connected with the pulling plate 52, to rotate in the clockwise direction (as shown in FIG. 3 and FIG. 4). The rotation of the guiding press plate 38 makes the scratch-off lottery ticket to be dispensed bend toward the direction of the cutter 36 (the anticlockwise direction in FIG. 5) along penetrative parting line of the lottery ticket tape 16, and makes the separating edge of the cutter 36 contact the penetrative parting line on the lottery ticket tape 16. At this time, the control device 23 sends a reverse rotation signal to the drive motor 22, and the drive motor 22 drives the first drive roller 18 and the second drive roller 40 to rotate reversely, thereby the lottery ticket tape 16 moves backward, and the scratch-off lottery ticket to be dispensed is cut off by the cutter 36 along the penetrative parting line that contacts the cutter 36, thus a lottery ticket is separated. At this time, the lottery ticket tape 16 continues to roll back, until the second sensor 44 transmits a signal to the control device 23 after detecting the position of the front edge of the lottery ticket tape 16, and the control device 23 transmits an instruction for stopping the drive motor 22; at this time, the front edge of the lottery ticket tape 16 stops at the position of the second sensor 44.

After the lottery ticket is separated, the control device 23 sends a signal to the linear electromagnet 50, so that the push rod of the linear electromagnet 50 rolls back. At this time, the pulling plate 52 is drawn by the restoring force of the spring 53 to rotate in the anticlockwise direction in FIG. 2, so that the guiding press plate 38 connected with the pulling plate 52 also rotates in the anticlockwise direction and recovers the position for starting the next ticket cutting action.

The lottery ticket dispensing device according to the invention may dispense a predetermined number of scratch-off lottery tickets automatically according to a user operation. The lottery ticket dispensing device employs a guiding press plate drive device, which includes a linear electromagnet, a lever, a pulling plate and a spring, to replace the solenoid or the mechanical clutch assembly of the prior art, so that the device cost may be lowered, the failure rate may be effectively reduced, and the service life of the machine may be increased. By adding a second drive roller and a ticket guiding device, it may be effectively prevented that failures such as ticket blocking and the like occur during ticket drawing.

Although the invention has been described referring to exemplary embodiments, it may be understood by one skilled in the art that, various variations may be made to the forms and details of the invention without departing from the spirit and scope of the invention as defined by the claims.

What is claimed is:

1. A lottery ticket dispensing device for dispensing scratch-off lottery tickets, comprising:

a housing;

a lottery ticket feeding device mounted on the housing, which comprises: a drive motor, a first drive roller and a driven roller, wherein the drive motor drives the first drive roller to rotate, the driven roller is pressed against the first drive roller, and a lottery ticket tape is allowed to pass between the first drive roller and the driven roller;

a cutter, which is fixed on the housing, for separating the lottery ticket tape;

a guiding press plate, which can rotate to make the lottery ticket tape bend toward the cutter and contact the cutter; a guiding press plate drive device, which comprises a linear electromagnet, a lever, a pulling plate and a spring, wherein the linear electromagnet is fixed on the housing, the lever is rotatably mounted on the housing, a first end of the lever contacts a push rod of the linear electromagnet, and a second end of the lever is rotatably connected with a first end of the pulling plate, a second end of the pulling plate is rotatably connected with the guiding press plate, a first end of the spring is fixed on the housing, and a second end of the spring is connected with the pulling plate; and a control device, which controls the rotation of the drive motor and thus controls the forward and backward movement of the lottery ticket tape, and further controls the driving and releasing of the linear electromagnet.

2. The lottery ticket dispensing device according to claim 1, further comprising: a second drive roller, which is mounted behind the first drive roller along the lottery ticket feeding direction and is set adjacent to the cutter.

3. The lottery ticket dispensing device according to claim 2, wherein, a rotation axis of the lever, a rotation axis of the guiding press plate and a rotation axis of the second drive roller are set coaxially, and the lever, the guiding press plate and the second drive roller rotate independently.

4. The lottery ticket dispensing device according to claim 1, further comprising: a ticket guiding device, which is mounted behind the first drive roller and the driven roller along the lottery ticket feeding direction and has a guide surface, wherein the ticket guiding device is set in such a way that a lottery ticket will contact the guide surface after the front edge of the lottery ticket leaves the first drive roller and the driven roller, so that the lottery ticket tape is guided to the cutter.

5. The lottery ticket dispensing device according to claim 1, further comprising: a first sensor and a second sensor, wherein the first sensor is set in front of the first drive roller and the driven roller along the lottery ticket feeding direction, and the second sensor is set behind the first drive roller and the driven roller along the lottery ticket feeding direction.

* * * * *